US012601109B2

(12) United States Patent
Veran

(10) Patent No.: US 12,601,109 B2
(45) Date of Patent: Apr. 14, 2026

(54) POLYESTER FABRIC FOR A BOAT TRACTION STRUCTURE

(71) Applicant: PORCHER INDUSTRIES, Eclose-Badinieres (FR)

(72) Inventor: Stéphane Veran, Aix les Bains (FR)

(73) Assignee: PORCHER INDUSTRIES, Eclose-Badinieres (FR)

( * ) Notice: Subject to any disclaimer, the term of this patent is extended or adjusted under 35 U.S.C. 154(b) by 372 days.

(21) Appl. No.: 18/259,814

(22) PCT Filed: Jan. 14, 2022

(86) PCT No.: PCT/EP2022/050799
§ 371 (c)(1),
(2) Date: Jun. 29, 2023

(87) PCT Pub. No.: WO2022/152882
PCT Pub. Date: Jul. 21, 2022

(65) Prior Publication Data

US 2024/0084504 A1 Mar. 14, 2024

(30) Foreign Application Priority Data

Jan. 15, 2021 (FR) ..... 2100401

(51) Int. Cl.

| | |
|---|---|
| ***D06N 3/14*** | (2006.01) |
| ***B63H 9/067*** | (2020.01) |
| ***D03D 1/00*** | (2006.01) |
| ***D03D 13/00*** | (2006.01) |
| ***D03D 15/283*** | (2021.01) |
| ***D03D 15/50*** | (2021.01) |
| ***D06N 3/00*** | (2006.01) |
| ***D06P 1/52*** | (2006.01) |
| ***D06P 3/52*** | (2006.01) |
| ***D06P 5/28*** | (2006.01) |

(52) U.S. Cl.

CPC ..... *D06N 3/14* (2013.01); *B63H 9/067* (2020.02); *D03D 1/00* (2013.01); *D03D 13/008* (2013.01); *D03D 15/283* (2021.01); *D03D 15/50* (2021.01); *D06N 3/0006* (2013.01); *D06N 3/0036* (2013.01); *D06P 1/5285* (2013.01); *D06P 3/52* (2013.01); *D06P 5/005* (2013.01); *D06N 2201/02* (2013.01); *D06N 2211/00* (2013.01); *D10B 2331/04* (2013.01); *D10B 2401/02* (2013.01); *D10B 2403/0112* (2013.01); *D10B 2505/12* (2013.01)

(58) Field of Classification Search
None
See application file for complete search history.

(56) References Cited

U.S. PATENT DOCUMENTS

| | | | | |
|---|---|---|---|---|
| 4,973,510 | A | 11/1990 | Tanaka | |
| 5,273,813 | A | 12/1993 | Akamatsu et al. | |
| 2011/0130061 | A1 | 6/2011 | Tanaka et al. | |
| 2019/0368124 | A1 | 12/2019 | Furui et al. | |
| 2023/0366147 | A1* | 11/2023 | Veran | D03D 1/00 |

FOREIGN PATENT DOCUMENTS

| | | |
|---|---|---|
| EP | 2 475 577 | 7/2012 |
| EP | 3779032 | 2/2021 |
| JP | 4369190 | 11/2009 |
| TW | 201943924 | 11/2019 |
| WO | WO 2011/042653 | 4/2011 |
| WO | WO 2022/073901 | 4/2022 |
| WO | WO 2022/073902 | 4/2022 |

OTHER PUBLICATIONS

International Search Report for PCT/EP2022/050799 dated Apr. 5, 2022.
Preliminary Search Report for FR 2100401 dated Nov. 2, 2021.
Taiwan Search Report for TW patent application 111101713 dated Mar. 20, 2025.

* cited by examiner

*Primary Examiner* — Arti R Singh-Pandey
(74) *Attorney, Agent, or Firm* — B. Aaron Schulman, Esq.; Stites & Harbison, PLLC

(57) ABSTRACT

A fabric for a ship traction structure is provided that is formed from multifilament continuous warp yarns and weft yarns and coated on one or both of its two surfaces with a polyurethane (PU), the fabric having a coverage rate TC of between 1.8 and 4, the yarns being made of poly(ethylene terephthalate) (PET) and a density of between 20 and 50 yarns/cm, in terms of warp and weft density, the polyurethane (PU) being crosslinked and polyether-, polyester-, or polycarbonate-based. The crosslinked PU is derived from crosslinking a single-component polyurethane having a modulus at 100% elongation less than or equal to 5 MPa according to standard DIN 53504, implemented in organic solvent phase and a crosslinking agent. A ship traction structure of the paraglider sail type made with such a fabric is also provided.

19 Claims, No Drawings

POLYESTER FABRIC FOR A BOAT TRACTION STRUCTURE

The present invention relates to a fabric usable for pulling ships, in particular to serve as secondary displacement means. This fabric is in particular intended to form all or part of an aerial traction structure, such as a paraglider sail with box sections. The invention also relates to the traction structures, in particular of the paraglider sail with box section type, in which this fabric forms the majority or all of the part of the structure formed by fabric. The invention also relates to a method for manufacturing this fabric.

There is a need to propose aerial traction structures usable as means allowing ships or vessels of a certain tonnage or of a certain size to be displaced, such as merchant ships, cargo ships, yachts, etc., in general vessels moved primarily by heat engines or operating on fossil energy. These aerial traction structures may in some cases be used only for the journey of the vessel. More generally, the structure is a backup or secondary means, supplementing the primary mode.

Nearly 90% of international trade currently passes through maritime routes. The combustion of heavy fuel creates emissions of $CO_2$, nitrogen oxide and sulfur oxide, posing an environmental problem. In order to reduce the dependency of maritime trade on fossil energies, players are developing the use of sails supported by masts or self-supporting sails. Others are turning to the use of traction devices such as free sails (kite-surfs) that are connected to the ship by a rope or line.

A fabric for a paraglider sail is for example described in document WO2011/042653. These, however, are sails developed to support an individual in an essentially fluid gliding practice with laminar air flows, which is not comparable to the conditions likely to prevail at sea when pulling a ship or vessel, due to the mass to be displaced, the resistance offered by the sea and depending on the sea conditions, and above all, the dynamic flight conditions. The stresses experienced by paraglider sails for gliding are generally about several kilograms per $m^2$. A homothetic or scale change approach to transition to pulling ships, with high tonnage units, would result in fabrics too heavy to allow a sail to be raised and to remain in the air.

The present invention aims to provide a fabric with stable porosity under the high stresses generated by the forces that it will experience during use in a maritime environment (water, moisture, salt, UV, etc.) when pulling ships or vessels of a certain tonnage or a certain size, such as merchant ships, cargo ships, fishing boats, yachts, etc.

Another objective of the invention is to provide such a fabric which retains the best mechanical properties necessary for use, with in particular an appropriate stiffness across the bias.

Another objective is to have the ability to print the fabric by sublimation printing, and therefore to be able to provide coated fabrics suitable for being printed in this manner.

Another objective of the invention is to propose such a fabric that is suitable for producing an aerial traction structure of the paraglider sail with box section type, in particular for producing the lower surface and the upper surface, and that is therefore suitable for such a use.

Another objective is to propose aerial traction structures, such as a paraglider sail structure with box sections, in which the component fabric has, and confers on the entire structure, a stable porosity under the high stresses generated by the forces that it will experience during use in a maritime environment (water, moisture, salt, UV, etc.) when pulling ships or vessels of a certain tonnage or a certain size, such as merchant ships, cargo ships, fishing boats, yachts, etc.

In particular, one objective of the invention is to propose such a fabric allowing the production of such structures, in particular the lower surface and upper surface, capable of pulling ships or vessels.

Yet another objective of the invention is to propose such a fabric that has all of the above-stated properties, but which at the same time is light enough for the aerial structure to be able to be sent, to rise, to remain in the air, to play its role under the wind conditions for which it is intended and to evolve based on the expected dynamic behavior.

Yet other objectives will become apparent upon reading the description of the invention which follows.

These objectives, as well as others, are achieved owing to a fabric that is capable of retaining a determined porosity owing to the combination of a textile structure having a suitable coverage rate (TC) and a polymer coating that is flexible enough to confer an elongation capacity on the coated fabric across the bias and durability on the coating. The fabric according to the invention is a compromise in particular between the total weight of the fabric, its durable porosity under the usage conditions, its durable dimensional stability during use, characterized by the elongation across the bias, and its mechanical strength, this compromise allowing a fabric and an aerial traction structure to be provided that meet the aforementioned objectives.

The fabric according to the invention is formed from multifilament continuous warp yarns and weft yarns made of poly(ethylene terephthalate) (PET) and coated on one or both of its two surfaces with a polyurethane (PU). The fabric preferably has a density of between 20 and 50 yarns/cm, in terms of warp and weft density. The polyurethane is advantageously a crosslinked polyurethane (PU) that is polyether-, polyester-, or polycarbonate based.

According to another preferred characteristic feature, the PU is obtained from a single-component polyurethane elastomer. This elastomer is formed from polyol segments (polyether, polyester or polycarbonate), isocyanate segments, and a chain extender or hydroxylated crosslinking agent, as is known per se. One important preferred characteristic feature is that the elastomer has a modulus at 100% elongation less than or equal to approximately 5 MPa, in particular between 1 and 4 MPa, in particular between 1 and 3 MPa, for example approximately 2 MPa, according to the standard DIN 53504. Another important preferred characteristic feature is that the elastomer is in a mixture with a crosslinking agent (not to be confused with the crosslinking agent used so as to form the elastomer). In particular, the proportion of dry crosslinking agent relative to the dry elastomer is between approximately 5% and approximately 30% by weight, in particular between approximately 7% and approximately 20% by weight, in particular between approximately 8% and approximately 18% by weight (for example approximately 8% and approximately 16% by weight). The crosslinking agent comprises in particular an isocyanate, melamine, or a mixture of isocyanate and melamine. This crosslinking agent makes it possible in particular to block all or part of the reactive functional groups (in particular NCO and alcohol) remaining on the elastomer, to create additional bonds or crosslinks, and to obtain the crosslinked PU forming the coating of the fabric.

The fabric according to the invention is intended or able to form ship traction structures, in particular, as will be described in detail later, structures of the paraglider sail type for this use.

The fabric advantageously has a coverage rate TC of between 1.8 and 4, in particular between 2.6 and 3.2. The TC (coverage rate) is that of the resulting PET fabric derived from the weaving operation, and prior to any possible calendering or similar operation. The TC is calculated as follows: TC=(number of filaments/cm×diameter of 1 filament in cm)$_{warp}$+(number of filaments/cm×diameter of 1 filament in cm)$_{weft}$. The TC values retained for the invention correspond to values that provide the fabric with a sufficiently closed configuration, possibly accentuated thereafter by an eventual and advantageous calendering process, making it possible, on the one hand, to limit the rate of uptake of the coating material in order to obtain a low porosity that is appropriate to the domain of use of the fabric, and consequently on the other hand, to limit the final weight of the coated fabric.

The invention relates in particular to a fabric, in particular for a ship traction structure, formed from continuous warp yarns and weft yarns and coated on one or both of its two surfaces with a polyurethane (PU), characterized in that the bare fabric having a coverage rate TC of between 1.8 and 4, in particular between 2.6 and 3.2, in that the yarns are made of poly(ethylene terephthalate) (PET), in that the fabric has a density of between 20 and 50 yarns/cm, in terms of warp and weft density, in that the polyurethane is a crosslinked PU that is polyether-, polyester-, or polycarbonate based, and in that this PU is derived from the crosslinking (1) of a single-component polyurethane elastomer having a modulus at 100% elongation less than or equal to 5 MPa, in particular between 1 and 4 MPa, in particular between 1 and 3 MPa, according to the standard DIN 53504, implemented in organic solvent phase (in particular dissolved in a solvent), (2) by a crosslinking agent, based on a proportion of dry crosslinking agent relative to the dry elastomer of between approximately 5% and approximately 30% by weight, in particular between approximately 7% and approximately 20% by weight, in particular between approximately 8% and approximately 18% by weight.

The fabrics according to the invention have a surprising ability to retain their initial porosity (when new), or to experience only a slight increase in this porosity, during aging under saline conditions and therefore during use of the fabric. At the same time, these fabrics also present the advantage of only undergoing a low level increase in terms of water absorption during the aging or use thereof. The formula has therefore been found that makes it possible to provide a fabric for an aerial traction structure, in particular of the paraglider type, which has excellent properties with respect to porosity, lower sensitivity, or indeed even insensitivity, to saltwater uptake, over the course of time and use, thereby making it possible to sustainably retain the properties of good mechanical performance allowing for efficient and safe use of the structure or sail.

The fabric may have a weight, including coating, greater than or equal to 43, 44, 45 or 50 g/m$^2$. This weight may also range from about 43, 44, 45 or 50 to about 250 g/m$^2$, in particular to about 130 g/m$^2$, for example to about 105 or 110 g/m$^2$.

According to one embodiment, the dry uptake rate of the coating material is greater than or equal to 10% by weight, in particular between 10 and 35%, typically between 10% and 30%, preferably between 12% and 30% by weight, better still between 12% and 25%. The dry uptake rate is the ratio by weight of dry coating (in particular crosslinked PU) on the coated fabric; it is representative of the weight of the dried/crosslinked coating present on the final fabric. This coating or uptake rate represents an optimization. An excess could be detrimental to certain properties and needlessly increase the weight.

PET is made up of repeating units of ethylene terephthalate; however, the scope of the invention indeed also extends to variants comprising a minor amount of other units, for example less than 10 mol %, in particular less than 5 mol % of other units, per molecular chain of the polyester (in order to form these other units the comonomers include, for example, isophthalic acid, naphthalene dicarboxylic acids, adipic acid, hydroxybenzoic acids, diethylene glycol, propylene glycol, trimellitic acid, and pentaerythritol).

The polyester yarns are multifilament yarns. They are formed from multiple continuous filaments. According to one embodiment, the fabric includes or is made up of warp yarns and weft yarns that have a count in dtex of between 33 and 470 dtex, for example between 44 and 115 dtex. For example, yarns are used having the following counts: 44, 80, 114 dtex. In particular, the DPF (decitex per filament) of the warp yarns and the weft yarns is between 1 and 4, preferably between 1.3 and 3.7.

In one embodiment, the warp yarns and the weft yarns have the same count and have the same DPF.

In another embodiment, the warp yarns and the weft yarns have different counts, the yarn count in one direction being strictly higher than the yarn count in the other direction. For example, the yarn count in one direction is between 33 and 470 dtex, in particular between 78 and 115 dtex, while the yarn count in the other direction is between 33 and 115 dtex, in particular between 44 and 78 dtex, the yarn count in the first direction being strictly higher than the yarn count in the other direction. According to one modality, the higher count yarns are in the weft direction. According to another modality, the higher count yarns are in the warp direction.

In another embodiment, it is possible to provide for variegated counts in a same given direction, either warp or weft, or in both warp and weft directions. In this case, in the warp and/or weft direction, there are at least two types of yarns having different counts.

The tenacity (or tensile strength) of the PET yarns is in particular greater than or equal to 6 cN/dtex, in particular between 6 and 7 cN/dtex. The elongation at break thereof is in particular greater than or equal to 20%, in particular between 20% and 30%. The tenacity and elongation at break are measured according to the standard DIN EN ISO 2062.

PET fibers or yarns with these characteristic features are commercially available and/or can be produced to order.

The polyester yarns optionally contain one or more additives, for example a stabilizing agent and/or an antistatic agent.

According to one embodiment, the PET fabric used in implementation is a calendered fabric, which means that it has undergone calendering prior to its being coated with the PU. Calendering crushes the fabric and spreads the yarns as well as the constituent filaments, which contributes to closing the pores of the fabric and reducing the porosity thereof.

The fabric of the present invention is obtained by coating with polyurethane in solvent phase. The coating may have any one of the characteristic features mentioned below. Firstly, the fabric may be coated on one or both of its two surfaces; preferably it is coated on one surface.

A polyurethane includes a stiff part (isocyanate) and a flexible part (polyol). The person skilled in the art knows how to find the compromise between the isocyanate/polyol ratio and the nature of the components in order to obtain the elastomer of the desired stiffness, characterized by the modulus at 100% elongation. Preferably, the elastomer used in the coating is a single-component elastomer, the isocyanate having reacted with the polyol, then with the chain extender or the crosslinking agent, forming an elastomer generally still containing reactive functional groups such as NCO and alcohol. The person skilled in the art may refer to the literature on the production of copolymers or elastomers obtained from isocyanate, polyol, and chain extenders or crosslinking agent, in particular to the Thèse en Matériaux Polymères et Composites [Thesis on Polymer Materials and Composites] by Ségolène Hibon, Institut National de Sciences Appliquées-INSA [National Institute of Applied Sciences] in Lyon, France, 2006.

The coating composition is supplemented by a crosslinking agent, in particular an isocyanate or a melamine, or even a mixture of the two. The term "isocyanate" is understood to refer to both an isocyanate and a polyisocyanate, either alone or as a mixture with one or more other isocyanates and/or polyisocyanates. The term "isocyanate" should be understood herein as including the terms "isocyanate" and "polyisocyanate". Polyisocyanates are preferred. As regards the melamine, it may in particular be melamine proper (1,3,5-triazine-2,4,6-triamine) or a compound or a resin containing melamine, for example a melamine-formaldehyde resin.

According to one embodiment, the proportion of dry crosslinking agent relative to the dry elastomer is between approximately 5% and approximately 30% by weight, in particular between approximately 7% and approximately 20% by weight, in particular between approximately 8% and approximately 18% by weight.

According to one embodiment, the polyurethane (and the starting elastomer) is polyether-based. In particular, the polyether-based polyurethane is linear or branched and comprises a polyol part of the polyether type and an isocyanate part.

According to one embodiment, the polyurethane (and the starting elastomer) is polyester-based. In particular, the polyester-based polyurethane is linear or branched and comprises a polyol part of the polyester type and an isocyanate part.

According to another embodiment, the polyurethane (and the starting elastomer) is polycarbonate-based. In particular, the polycarbonate-based polyurethane is linear or branched and comprises a polyol part of the polycarbonate type and an isocyanate part.

As regards the elastomer and the crosslinking agent, the isocyanate part is preferably aliphatic, in fact aromatic isocyanates have the drawback of turning yellow over time, thereby making them less preferred, even though they can be used.

In one embodiment, the fabric of the present invention is obtained by coating with polyurethane in solvent phase. This fabric production method for producing a coated fabric from the polyester fabric is another object of the invention. The coating may have any one of the characteristic features mentioned below.

The coating step is carried out by the techniques conventionally used in the coating of textiles, such as direct coating. The term "direct coating" is understood to refer to a direct deposition coating process, for example making use of a doctor blade, a cylinder, an air knife, a padder, using the Meyer rod (or Champion process).

In one embodiment, the fabric of the present invention is characterized by stiffness across the bias. The bias is said to be the warp direction when it is measured along the direction at 45° to the warp yarns. The bias is said to be the weft direction when it is measured along the direction at 45° to the weft yarns. The elongation is measured in percentage under a force of 3 pounds (Lbs, which is 1.36 kg) applied along the bias. This elongation characterizes the stiffness of the fabric across the bias. The standard used is NF EN ISO 13934-1: test specimens measuring 50 mm in width and 300 mm in length are produced. The clamp jaws of the dynamometer are spaced 200 mm apart and the measurement is performed at a speed of 100 mm/min.

In particular, the coated fabric according to the invention has an elongation in the bias along the warp and weft directions under 3 lbs or 1.36 kg, that is less than or equal to 10%. This elongation may thus be between 1% and 10%, preferably between 3% and 10%.

According to one embodiment, when new, the fabric has a porosity or an air permeability of less than or equal to 20 $L/m^2/min$ under a pressure of 2000 Pa, as measured according to standard NFG 07111 (measurement surface area of 100 $cm^2$); and/or (preferably and) water absorption according to the Tappi 441 om-90 standard of less than or equal to 1%, in particular less than or equal to 0.9%, for example less than or equal to 0.5%.

The fabric of the invention advantageously exhibits high durability, in particular high water stability. This stability may be assessed by various accelerated aging methods, described in the examples section: The porosity or air permeability and water adsorption properties evolve little after use in the case of a fabric according to the invention:

- porosity or air permeability after hydrolysis and mechanical stress: after aging, it preferably remains less than or equal to 30 $L/m^2/min$, in particular less than or equal to 20 $L/m^2/min$, in particular less than or equal to 15 $L/m^2/min$ according to standard NFG07111; and/or
- water absorption according to the Tappi 441 om-90 standard remains less than or equal to 1%, in particular less than or equal to 0.9%, for example less than or equal to 0.5%.

Fabrics making it possible to produce structures of the paraglider sail type capable of pulling ships or vessels, in particular capable of bearing the stresses applied to these sails. These fabrics have the above-stated properties, are light enough for the aerial structure to be able to be sent, to rise, to remain in the air, to play its role under the wind conditions for which it is intended and to evolve based on the expected dynamic behavior.

Another object of the invention is the use of a PU elastomer or a crosslinked PU coating as defined herein, for the coating of a high tenacity PET fabric as defined herein. This coating is intended in particular to give the fabric the property or properties described herein, in particular an elongation in the bias direction as described herein; and/or very low water absorption when new and after aging or use as described herein; and/or a porosity which exhibits no or only slight increase between the new coated fabric and the coated fabric after aging or use as described herein. This use may result in the production method that follows, which is another object of the invention.

The fabric production method for producing a coated fabric includes in particular the following steps:

(a) a polyester fabric according to the invention is provided; this fabric may optionally be calendered;

(b) one or both of the two surfaces of this fabric is/are coated making use of a polyurethane in solvent phase according to the invention, preferably from a single-component elastomer dissolved in the solvent and in a mixture with the crosslinking agent, as described herein, with a rate of coating in accordance with the invention;

(c) the fabric is heated until drying and crosslinking of the coating;

(d) a coated fabric in accordance with the invention is obtained;

(e) optionally, the fabric is printed, for example by sublimation printing, on one or both of its two surfaces.

The object of the invention relates in particular to a fabric production method for producing a coated fabric in which:

a fabric is provided, the fabric made of poly(ethylene terephthalate) (PET) having a density of between 20 and 50 yarns/cm, in terms of warp and weft density;

one or both of the two surfaces of this fabric is/are coated making use of a mixture of: a single-component polyurethane elastomer having a modulus at 100% elongation less than or equal to approximately 5 MPa, in particular between 1 and 4 MPa, in particular between 1 and 3 MPa, according to standard DIN 53504; a solvent for the elastomer; and a crosslinking agent; based on a proportion of dry crosslinking agent relative to the dry elastomer of between approximately 5% and approximately 30% by weight, in particular between approximately 7% and approximately 20% by weight, in particular between approximately 8% and approximately 18% by weight;

the fabric is heated until drying and crosslinking of the coating;

a coated fabric is obtained;

optionally, the fabric is printed, for example by sublimation printing, on one or both of its two surfaces.

This method is aimed at producing a fabric as described above and consequently, the characteristic features of the elements that are used in the production of the fabric are applicable to the method, to the selection of these elements for use thereof in the method, without having to repeat them in the following sections.

The PET fabric can undergo calendering prior to coating.

According to one embodiment, the PET fabric is calendered prior to coating between a tool, cylinder or calender roller and a counter plate. The surface of the fabric which has been subjected to the passing of the calendering tool, referred to as the "calendering surface", is smoothed as compared to the other surface.

According to one modality, the coating is effected on this calendering surface. The adhesion of the polymer can be enhanced by first applying in advance a primer treatment to this smooth surface. It may be a physical treatment or a chemical treatment. It is for example a chemical treatment providing functional groups capable of reacting with the groups of the polymer in order to form chemical bonds.

According to another modality, the coating is effected on the other surface, which is not smoothed. It should be understood that the rate of coating uptake varies depending on the surface concerned, this rate being higher on the non-smoothed surface, which enables a person skilled in the art to adjust the quantity and the weight of the coating. It is also possible to coat both surfaces.

According to another embodiment, the PET fabric is calendered prior to coating between two calendering tools, cylinders or calender rollers. Both surfaces of the fabric are smoothed. One or both of the two surfaces are subsequently coated, with or without an adhesion treatment as described above.

The calendering of the PET fabric is preferably carried out at a temperature of between 150 and 250° C., preferably between 180 and 210° C. The calendering is preferably carried out with a pressure ranging from 150 to 250 kg, preferably between 180 and 230 kg. The rotational speed of the calender may be between 1 and 30 m/min, preferably between 10 and 20 m/min.

The fabric of the present invention is obtained by coating with polyurethane in solvent phase. The coating may have any one of the characteristic features mentioned below.

The PU has a modulus at 100% elongation less than or equal to approximately 5 MPa, in particular between 1 and 4 MPa, in particular between 1 and 3 MPa, according to the standard DIN 53504. It is placed in solution in an organic solvent. The polymer is dissolved in the medium. The crosslinking agent for the PU is added to this solution. In particular, the proportion of dry crosslinking agent relative to the dry polyurethane is between approximately 5% and approximately 30% by weight, in particular between approximately 7% and approximately 20% by weight, in particular between approximately 8% and approximately 18% by weight.

The fabric of the present invention is obtained by coating with polyurethane dissolved in a solvent. In particular, the coating contains the single-component elastomer (formed in particular from isocyanate, polyol and the chain extender or the crosslinking agent), in solution in the solvent. The film forms naturally during the evaporation of the solvent. The solvent is an organic solvent and may in particular be selected from the group constituted of aromatic solvents, alcohols, ketones, esters, dimethylformamide, and n-methylpyrolidone. In one particular embodiment, the solvent is selected from the group constituted of toluene, xylene, isopropanol, butanol, 1-methoxypropan-2-ol, methyl ethyl ketone, acetone, butanone, ethyl acetate, dimethylformamide, n-methylpyrolidone, and a mixture of at least two of the aforementioned. For example, a mixture of toluene and isopropanol.

In one embodiment, the solvent-phase polyurethane may be characterized by its concentration of between 20% and 50% by weight of non-crosslinked PU, in particular a single-component elastomer, relative to the PU and solvent mixture. In one embodiment, this solvent-phase polyurethane, in particular the elastomer in solution in the solvent, may be characterized by a viscosity of less than 100,000 mPa·s at 23° C., preferably between 5,000 and 60,000 mPa·s at 23° C. (according to the standard DIN EN ISO/A3).

In particular, the drying and crosslinking step comprises firstly the drying, for example at a temperature of between approximately 90 and approximately 120° C., thereafter the crosslinking at a temperature of between approximately 140 and approximately 210° C.

The fabric coating composition of the present invention may in addition include additives. Said additives may be any additive commonly used in fabric coating compositions. They are in particular selected from the group constituted of viscosity modifiers, UV stabilizers, dyes, dispersants, and surfactants. According to one embodiment, the coating comprises an anti-UV agent.

In one embodiment, the method comprises after the drying and crosslinking step one or more post-treatment step(s) that confer on the fabric anti-fouling and/or water-repellent properties. The term "anti-fouling treatment" is understood to refer to a treatment making use of anti-static and/or anti-tack products. The term "water-repellent treatment" is understood to refer a treatment making use of fluorinated resins with or without a crosslinking agent for the fluorinated resin, for example an isocyanate. The water-repellent treatment is followed by a drying/crosslinking step. In one embodiment, the post-treatment is applied by any method known to the person skilled in the art and in particular by padding, coating, spraying or plasma treatment.

The coated fabrics described herein are found to be capable of being printed by the so-called sublimation printing technique. According to one aspect of the invention, this coated fabric is colored, printed or decorated by a sublimation technique. This latter may in particular be implemented by printing a pattern on a substrate (transfer substrate) with one or more dyes which can be sublimated at high temperature. The substrate is thereafter applied in contact with the coated fabric, then hot calendered, for example at approximately 200° C. and under pressure. The dyes pass into the gas phase and are transferred into the coating, and/or to the surface and/or to the fiber. The polyester PET remains stable at this temperature The fabrics of examples 1, 1bis, 2 and 2bis are embodiments of fabrics and traction structures or sails according to the invention. They are defined by their component characteristic features set out in the examples.

The object of the invention also relates to a fabric that is obtained or capable of being obtained by implementing the method according to the invention. It also relates to a method for manufacturing an aerial traction structure, comprising manufacturing the fabric as it is described here, or having a fabric as described here, and making all or part of the aerial structure with this coated fabric, in particular for manufacturing the lower surface (bottom sail) and/or the upper surface (top sail) of such a structure in the form of a paraglider sail with box sections (cells). The invention also relates to the use of a coated fabric as described here, for producing an aerial traction structure for a ship, in particular for producing the lower surface and/or the upper surface of such a structure in the form of a paraglider sail with box sections.

The invention also relates to an aerial traction structure including or made from a fabric according to the invention. "Aerial traction structure" refers to a structure or sail comprising at least one layer of fabric according to the invention, able to be connected to a ship or vessel and to ensure or contribute to the displacement of said ship or vessel under the effect of the wind, real and/or apparent. Advantageously, the structure includes two layers of this fabric, superimposed and held together in said structure, and forming the layer serving as lower surface and the layer serving as upper surface. In particular, the structure is of the paraglider sail with box section type, and preferably includes two layers of fabric (lower surface and upper surface), both made with the fabric of the invention. To have lower surfaces and upper surfaces with the desired dimensions, the latter are an assembly of panels or rolls or pieces of fabric according to the invention, in particular by sewing. The lower surface and the upper surface can be made with the same fabric, with different fabrics, or can include one and/or the other of the assemblies of different fabrics, according to the invention.

The two layers of fabric are connected by partitions, which may be made from the same fabric or from another fabric. In one embodiment, the partitions are also made from PET fabric with a PU coating of the same nature as that of the fabrics described above. However, it is preferred to use PUs with a modulus at 100% elongation of between about 6 and about MPa and a crosslinking agent rate between about 40 and about 200% by weight.

The structure can bear a pattern printed by sublimation, in particular on the lower surface and/or the upper surface in the case of a paraglider-type sail.

The traction structure, in particular the lower surface and the upper surface of a paraglider-type structure, can have a surface of between 50, 100 or 200 and 800 $m^2$, in particular between 100 and 500 $m^2$.

The traction structures can be used and sized for use on ships of various tonnages, in particular tonnages between 100 tons and 550,000 tons, for example between 10,000 and 260,000 tons.

Conventionally, as described in EP 2,475,577 (the entire content of which is incorporated here by reference), the paraglider-type sail according to the invention has a lower surface and an upper surface. At the front of the sail, the lower surface and the upper surface are connected by a leading edge, while at the rear of the sail, the lower surface and the upper surface come together to form a trailing edge. Between the lower surface and the upper surface, anteroposterior box sections are delimited, which open toward the front on the leading edge and which are separated in pairs, along the lateral direction, by inter-box walls.

The components of the sail, in particular its lower surface, its upper surface and its inter-box walls, are made up of pieces of fabric, securely assembled to one another, in particular by sewing. Each piece, each component of the sail, is thus made up essentially, if not exclusively, by a fabric according to the invention.

This fabric is formed by continuous warp yarns and continuous weft yarns, these warp and weft yarns being interlaced according to conventional weaving techniques. As an example, the mesh of the fabric is square. This fabric can be of the ripstop type, that is to say, incorporating reinforcing yarns to improve the anti-tear performance of the fabric.

The assembly of the pieces is provided so that, within the sail, the warp yarns extend lengthwise along the anteroposterior direction AP of the sail, while the weft yarns extend lengthwise along the lateral direction L. In other words, projected in a horizontal plane, the warp and weft yarns respectively extend parallel to the anteroposterior direction AP and to the lateral direction L, both for the fabric of the parts belonging to the lower surface and the upper surface, and for the fabric of the pieces making up the inter-box walls.

The invention will now be described with the aid of examples corresponding to the preferred embodiments, these being provided by way of illustration without however any limitation whatsoever.

EXAMPLES 1 AND 1BIS

These examples compare the impact of a polyurethane coating on one surface of a conventional polyamide 6.6 fabric coated with stiff PU (Control 1), a polyester fabric coated with stuff PU on one surface (Control 2) and high tenacity polyethylene terephthalate (PET) fabrics coated on one surface with a PU (examples according to invention).

Control 1: PA6.6 is a conventional polyamide fabric in the spinnaker field, with a PU coating obtained from PU elastomer having a modulus at 100% elongation of 8 MPa and isocyanate+melamine formaldehyde crosslinking agent. The proportion of dry crosslinking agent relative to the dry elastomer is 66.9%. The PU is used in a 50/50 mixture of toluene and isopropanol.

Control 2: a PU coating obtained from PU elastomer having a modulus at 100% elongation of 32.4 MPa and isocyanate+melamine formaldehyde crosslinking agent. The proportion of dry crosslinking agent relative to the dry elastomer is 137%. The PU is used in a 50/50 mixture of toluene and isopropanol.

The PET has a PU coating obtained from PU elastomer having a modulus at 100% elongation of 2 MPa and isocyanate+melamine formaldehyde crosslinking agent. The proportion of dry crosslinking agent relative to the dry elastomer is 8.4%. Examples 1 and 1bis differ by the dry uptake rate of the coating material. The PU is used in a 50/50 mixture of toluene and isopropanol.

In both controls and in the example of the invention, the PU is a single-component PU that is aliphatic polycarbonate based.

The tenacity of the PET is 6.6 cN/dtex. The elongation at break is 21%.

The coating is effected by using a doctor blade, and is followed by a step of drying at 100° C., and then a step of crosslinking at 180° C. The speed is 27 m/min.

TABLE 1

| | Control 1 | Control 2 | Example 1 According to the invention | Example 1bis According to the invention |
|---|---|---|---|---|
| Type of yarn | PA6.6 | PET | PET | PET |
| Count (dtex) (warp and weft) | 110 | 114 | 114 | 114 |
| DPF | 3.2 | 3.6 | 3.6 | 3.6 |
| Number of warp yarns × weft yarns | 35 × 30.0 | 33.6 × 30.5 | 33.6 × 30.5 | 33.6 × 30.5 |
| Coated weight (g/m$^2$) | 85.2 | 84 | 90 | 100 |
| Dry uptake rate of the coating material (%) | 9.3 | 9.4 | 13.2 | 22.7 |
| Porosity - new (L/m$^2$/min) | 5 | 6 | 2 | 2 |
| Porosity - post aging (L/M$^2$/min) | 44 | >200 | 7 | 2 |
| Water absorption - new (%) | 0.2 | 0.1 | 0.1 | 0.1 |
| Water absorption - post aging (%) | 1.8 | 1.3 | 0.7 | 0.7 |
| Elongation in the bias under 3 lbs or 1.36 kg (%) | 0.9 | 0.5 | 4.1 | 3.6 |

Methods for measuring the porosity and the water absorption outlined later.

Examples 2 and 2Bis

These examples compare the impact of a polyurethane coating on one surface of a conventional polyamide 6.6 fabric coated with stiff PU (Control 3), a polyester fabric coated with stuff PU on one surface (Control 4) and high tenacity polyethylene terephthalate (PET) fabrics coated on one surface with a PU (examples according to invention).

Control 3: PA6.6 is a conventional polyamide fabric in the spinnaker field, with a PU coating obtained from PU elastomer having a modulus at 100% elongation of 8 MPa and isocyanate+melamine formaldehyde crosslinking agent. The proportion of dry crosslinking agent relative to the dry elastomer is 66.9%. The PU is used in a 50/50 mixture of toluene and isopropanol.

Control 4: a PU coating obtained from PU elastomer having a modulus at 100% elongation of 8 MPa and isocyanate+melamine formaldehyde crosslinking agent. The proportion of dry crosslinking agent relative to the dry elastomer is 66.9%. The PU is used in a 50/50 mixture of toluene and isopropanol.

The PET has a PU coating obtained from PU elastomer having a modulus at 100% elongation of 2 MPa and isocyanate+melamine formaldehyde crosslinking agent. The proportion of dry crosslinking agent relative to the dry elastomer is 15.4% for example 2 and 8.4% for example 2bis. Examples 2 and 2bis also differ by the dry uptake rate of the coating material. The PU is used in a 50/50 mixture of toluene and isopropanol.

In both controls and in the example of the invention, the PU is a single-component PU that is aliphatic polycarbonate based.

The tenacity of the PET is 6.6 cN/dtex. The elongation at break is 21%.

The coating is effected by using a doctor blade, and is followed by a step of drying at 100° C., and then a step of crosslinking at 180° C. The speed is 27 m/min.

TABLE 2

| | Control 3 | Control 4 | Example 2 According to the invention | Example 2bis According to the invention |
|---|---|---|---|---|
| Type of yarn | PA6.6 | PET | PET | PET |
| Count (dtex) (warp and weft) | 50 | 44 | 44 | 44 |
| DPF | 3.8 | 3.2 | 3.2 | 3.2 |
| Number of warp yarns × weft yarns | 42 × 42 | 39.3 × 39 | 39.3 × 39 | 39.3 × 39 |
| Coated weight (g/m$^2$) | 54.8 | 47 | 44.9 | 52 |
| Dry uptake rate of the coating material (%) | 15.4 | 21.9 | 18.0 | 30.0 |
| Porosity - new (L/m$^2$/min) | 5 | 2 | 2 | 2 |
| Porosity - post aging (L/M$^2$/min) | 75 | >200 | 27 | 4 |
| Water absorption (%) | 0.2 | 0.1 | 0.1 | 0.1 |

TABLE 2-continued

| | Control 3 | Control 4 | Example 2 According to the invention | Example 2bis According to the invention |
|---|---|---|---|---|
| Water absorption - post aging (%) | 0.8 | 0.3 | 0.2 | 0.2 |
| Elongation in the bias under 3 lbs or 1.36 kg (%) | 1.2 | 0.9 | 3.2 | 8.9 |

Methods for measuring the porosity and the water absorption outlined later.

Conclusions on the Two Examples:

The PA6.6 substrate is not ideal because of its higher water uptake after aging. The coated fabrics according to the invention have good porosity (air permeability) properties, and this good porosity is stable, as demonstrated by the test with aging. The superior test across the bias for the fabrics according to the invention contributes to this maintenance of the porosity. The fabrics of the invention also have the best behavior in terms of water absorption when new and after aging. These properties make these fabrics suitable for use to form aerial traction structures used in a marine environment.

Methods and Measurements Used in the Application (Characteristic Features of the Invention and Examples):

NF EN ISO 2062-Determination of the breaking strength and elongation at break of individual yarns making use of a constant rate of elongation test apparatus, using Method A of the standard.

- Breaking force (unit centiNewton—cN): maximum force developed to break the sample during a tensile test leading to breakage
- Elongation at break (%): increase in the length of the sample measured at breakage of the latter
- Tenacity (cN/tex): quotient of the breaking force expressed in cN by the linear density of the yarn expressed in dtex (1 tex=1 g per 1000 m of yarn length).
- The test makes it possible to measure the force and the elongation at break of the sample, characteristic variables of the yarn.
- The yarn is placed between two fixing clamps, spaced apart by 500 mm. The apparatus (Dynamometer) then moves the clamps away from each other at a constant displacement speed of 500 mm/min and measures the applied force continuously. The force required to break the yarn is measured as well as the increase in length of the yarn upon breakage.

The mean breaking force and mean elongation at break are the two data items characterized by this test. The tenacity is calculated based on dividing the breaking force by the linear density.

The modulus at 100% elongation of the single-component polyurethane elastomer is measured according to the standard DIN 53504. The modulus is defined in 3.4 of the standard "*Spannungswerte*". The measurement is carried out on test specimens that are dumbbell-shaped (Schulterstab) of type S2, however with a bar length Is of 55 mm and a thickness of 200 μm. The equipment used is a dynamometer. The dumbbell specimen is placed in the fixing clamps, spaced apart by a length Lo with the minimum possible pre-tension. The clamps are then moved away from each other at a constant speed of 400 mm/min and the dynamometer measures the force applied as a function of the elongation. The modulus or stress at 100% elongation in MPa is the force ratio measured at 100% elongation on the initial section of the test specimen. This is described in paragraph 9.4 *Spannungswerte* of the standard DIN 53504.

The porosity (air permeability) and water absorption are to be, and have been evaluated when new and post aging.

For the aging, the porosity of the fabric after hydrolysis is also measured. In order to do this, the fabric is placed for 4 hours in a 'Cocotte Minute' pressure cooker with saltwater at 30 g/l at operating temperature and pressure. Subsequently, 30 minutes of treatment is applied by floating the fabric in open air and at high speed, the fabric being fixed to a mill-type assembly (4 blade assembly, the fabric being fixed to the end of one of the blades).

The water absorption when new and post aging is to be and has been measured according to the Tappi 441 om-90 standard. It is expressed in percentage. The equipment consists of a square rubber substrate and a metal ring clad at its base with a rubber gasket. The sample is placed on the square substrate and the metal ring is placed on the sample. A clamping device is used to make the system watertight. A certain quantity of water (100 ml) is placed in the ring, in contact with the sample for a determined time (1 minute). When the time has elapsed, the water is removed from the cylindrical ring, the water residue remaining on the surface of the sample is removed by using a cylinder as described in the standard, via a to-and-fro movement of this cylinder over the sample placed between two blotters, without applying pressure. The percentage of water absorbed is determined by calculating the difference in weight before and after the contact with water.

The porosity is to be, and has been measured when new and post aging in accordance with standard NFG 07111 or the standard NF EN ISO 9237-Determination of the air permeability of fabrics; the latter replacing the former, however giving identical results. The sample is mounted on a circular sample holder. A suction is started in order to create a depression of 2000 Pa which induces an air flow through the sample. The flow rate of this flow is measured and given in $L/m^2/min$.

The elongation in percentage of the fabric is to be measured, and has been measured, under a force of 3 pounds (lbs) or 1.36 kg, applied across the bias. This elongation characterizes the stiffness of the fabric across the bias. The standard used is NF EN ISO 13934-1. Test specimens measuring 50 mm in width and 300 mm in length are to be, or have been, produced. The clamp jaws of the dynamometer are moved away from each other by 200 mm and the measurement is to be, and has been performed at a speed of 100 mm/min.

The invention claimed is:

1. An aerial traction structure for a ship, comprising at least one layer of a coated fabric made of a bare fabric having two surfaces and formed from multifilament continuous warp yarns and weft yarns and coated on one or both of its two surfaces with a polyurethane (PU) as a coating material, wherein the bare fabric has a coverage rate TC of between 1.8 and 4, the TC being calculated according to the formula TC=(number of filaments/cm×diameter of 1 filament in cm)$_{warp}$+(number of filaments/cm×diameter of 1 filament in cm)$_{weft}$, the warp yarns and weft yarns are made of poly(ethylene terephthalate) (PET), the bare fabric comprises or is made up of warp yarns and weft yarns having a dtex of between 33 and 470 dtex and has a density of between 20 and 50 yarns/cm, in terms of warp and weft density, the polyurethane is a crosslinked PU that is polyether-, polyester-, or polycarbonate based, and the crosslinked PU is obtained by crosslinking (1) of a single-component polyurethane having a modulus at 100% elongation less than or equal to 5 MPa, according to the standard DIN 53504, used in implementation in organic solvent phase; (2) by a crosslinking agent, based on a proportion of dry crosslinking agent relative to the dry elastomer of between 5% and 30% by weight, and the coated fabric has a weight, including coating, ranging from 43 to 250 g/m$^2$.

2. The structure according to claim 1, wherein the bare fabric has a coverage rate TC of between 2.6 and 3.2.

3. The structure according to claim 1, wherein the single-component polyurethane has a modulus at 100% elongation of between 1 and 4 MPa, according to the standard DIN 53504.

4. The structure according to claim 1, wherein the single-component polyurethane has a modulus at 100% elongation of between 1 and 3 MPa, according to the standard DIN 53504.

5. The structure according to claim 1, wherein the proportion of dry crosslinking agent relative to the dry elastomer is between 7 and 20% by weight.

6. The structure according to claim 1, wherein the tenacity of the PET yarns is greater than or equal to 6 cN/dtex, and the elongation at break of these PET yarns is greater than or equal to 20%, according to the standard DIN EN ISO 2062.

7. The structure according to claim 1, wherein the tenacity of the PET yarns is between 6 and 7 cN/dtex, and the elongation at break of these PET yarns is between 20% and 30%, according to the standard DIN EN ISO 2062.

8. The structure according to claim 1, wherein the coated fabric has a weight, including coating, ranging from 44 to 250 g/m$^2$.

9. The structure according to claim 1, wherein the coated fabric has a weight, including coating, ranging from 44 to 130 g/m$^2$.

10. The structure according to claim 1, wherein the dry uptake rate of the coating material is between 10 and 35% by weight.

11. The structure according to claim 1, wherein the bare fabric comprises or is made up of warp yarns and weft yarns that have a dtex of between 33 and 470 dtex, with a DPF (decitex per filament) of between 1 and 4.

12. The structure according to claim 1, wherein the crosslinking agent of the PU is an isocyanate, a polyisocyanate, melamine, a compound comprising melamine, or a mixture of isocyanate and melamine.

13. The structure according to claim 1, wherein the coated fabric has an air permeability of less than or equal to 20 L/m$^2$/min under a pressure of 2000 Pa, as measured according to standard NFG 07111 over a measurement surface area of 100 cm$^2$, and/or water absorption according to the standard Tappi 441 om-90 of less than or equal to 1%, whether new or post aging.

14. The structure according to claim 1, wherein the coated fabric has an elongation in the bias along the warp and weft directions under 1.36 kg, that is less than or equal to 10%, according to the standard NF EN ISO 13934-1.

15. The structure according to claim 1, wherein the coated fabric has an elongation in the bias along the warp and weft directions under 1.36 kg, that is between 1% and 10%, according to the standard NF EN ISO 13934-1.

16. The structure according to claim 1, wherein the coated fabric bears a pattern printed by sublimation.

17. The structure according to claim 1, wherein the structure is of a paraglider sail with box section type, including a lower surface and an upper surface, the lower surface and the upper surface being made with said coated fabric.

18. The structure according to claim 17, wherein the lower surface and the upper surface have a surface area of between 50 and 800 m$^2$.

19. A method for manufacturing the aerial traction structure for a ship according to claim 1, said method comprising manufacturing a coated fabric, said manufacturing comprising:

providing a bare fabric having two surfaces, said fabric being made of poly(ethylene terephthalate) (PET) having a density of between 20 and 50 yarns/cm, in terms of warp and weft density;

wherein one or both of the two surfaces of this fabric is/are coated making use of a mixture comprising a single-component polyurethane elastomer having a modulus at 100% elongation less than or equal to 5 MPa, according to standard DIN 53504; a solvent for the elastomer; and a crosslinking agent; based on a proportion of dry crosslinking agent relative to the dry elastomer of between 5% and 30% by weight; and heating the fabric with said mixture until drying and crosslinking of the coating so that a coated fabric is obtained;

wherein all or part of the aerial structure is made with said coated fabric.

* * * * *